United States Patent [19]

Skahill

[11] Patent Number: 4,479,129

[45] Date of Patent: Oct. 23, 1984

[54] DIRECTIVE ANTENNA SYSTEM EMPLOYING A PARABOLOIDAL MAIN DISH AND ELLIPSOIDAL SUBDISH

[76] Inventor: George Skahill, 159 Clay Pitts Rd., Greenlawn, N.Y. 11740

[21] Appl. No.: 301,056

[22] Filed: Sep. 10, 1981

[51] Int. Cl.[3] ..... H01Q 19/19

[52] U.S. Cl. ..... 343/781 P; 343/840

[58] Field of Search ..... 343/781 P, 781 CA, 840, 343/371, 372

[56] References Cited

U.S. PATENT DOCUMENTS

| | | | |
|---|---|---|---|
| 3,414,904 | 12/1968 | Ajioka | 343/781 CA |
| 3,877,032 | 4/1975 | Rosa et al. | 353/371 |
| 3,914,768 | 10/1975 | Ohm | 343/781 CA |
| 4,284,992 | 7/1981 | Gans | 343/781 P |
| 4,364,052 | 12/1982 | Ohm | 343/781 P |

*Primary Examiner*—Eli Lieberman

[57] ABSTRACT

Directive antenna or radio telescope systems in which a large aperture objective directs incident electromagnetic energy onto a relatively much smaller field element which in turn directs it upon a small directive feed such as a phased array.

3 Claims, 4 Drawing Figures

DIRECTIVE ANTENNA SYSTEM EMPLOYING A PARABOLOIDAL MAIN DISH AND ELLIPSOIDAL SUBDISH

SUMMARY

This invention relates to directive antennas or radio telescopes providing a relatively wide angular field of view at a primary radiator or sensor surface wherein image abberations are minimized by means of a field element and control of phase distribution on the sensor surface.

Multiple reflector and/or lens antenna systems in general are well known, having appeared in various designs of radars and radio telescopes in the prior art. Such designs have exhibited one or more of the following disadvantages. First, they do not simultaneously use the full aperture or area of the objective element and the full area of the sensor surface, owing to the phenomenon called vignetting. Accordingly, either one or both of said surfaces must be made larger than would be required if vignetting did not occur. Second, compensations for aberrations such as coma and vignetting require both phase and amplitude distribution control over the sensor surface. Third, the angular field of view decreases with frequency.

The principal object of this invention is to provide systems in which all of the foregoing disadvantages are minimized or avoided.

DRAWING

DESCRIPTION

Figure 1:
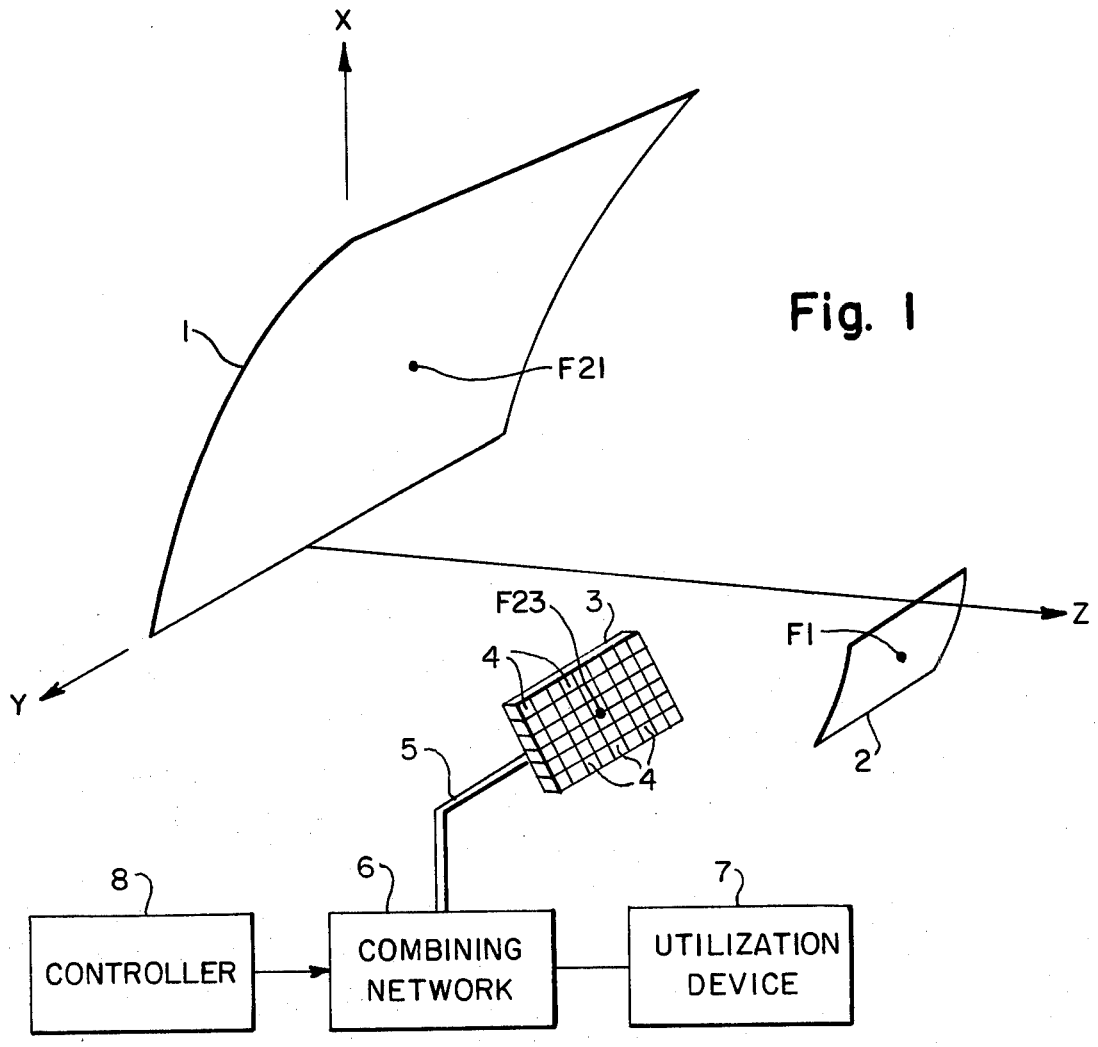
FIG. 1 is a schematic pictorial diagram showing in an approximate perspective the objective, field element and primary array or sensor surface of an antenna system in a presently preferred embodiment of this invention.

Referring to FIG. 1, a presently preferred embodiment of the invention in a multiple reflector system includes an objective 1, a field element 2 and a primary radiator or sensor 3. The device 3 in this instance consists of an array of radiator elements 4 coupled individually by wave guides or transmission lines, represented collectively by the heavy line 5, to a combining network 6.

Network 6 may be any of a number of well known combinations of phase shifters and amplitude controllers arranged to couple all of the elements 4, in selectable phase and amplitude relationships to each other, to one or more common main ports each adapted to be connected to a respective utilization device such as a transmitter, receiver, or transceiver. For simplicity of explanation, a single main port of combining network 6 is shown connected to a utilization device 7 which may be considered either as a transmitter or as a receiver.

Although each individual element of the combining network 6 could be adjusted manually to provide a desired overall directive pattern, it is assumed here that they are electrically adjusted by a controller 8 of known type, which may be designed to provide scanning, tracking or pointing of the directive pattern throughout a field of view. Alternatively, the network 6 could remain fixed, and be provided with a plurality of main ports and associated utilization devices, each assigned to a respective area of the field of view. All of the above arrangements and methods of operation are well known, and form no part of the present invention, although any of them may be used with it.

The objective 1 consists of a concave sheet of reflective material in the form of a section of a paraboloid of revolution about the axis represented by the arrow Z in FIG. 1. Its focus is at the point F1, near or at the center of the surface of the field element 2.

The field element 2 is a concave sheet of reflective material in the form of a section of an ellipsoid of revolution with two foci, F21 and F23. Focus F21 is disposed at or near the center of the surface of the objective 1, and focus F23 is disposed at or near the center of the primary radiator or sensor surface 3. The term "feed" is used hereinafter to mean radiator or sensor, or both. Element 2 is denoted a "field" element because its function is similar to that of a field lens in an optical device.

The field element 2 is located somewhat below the lower edge of the objective 1 so as not to obscure any of the intended field of view of the objective, lying within a predetermined solid angle about the axis Z. The feed surface 3 is located somewhat lower than the field element 2 and facing it in such a manner that a single ray, arriving at the center of objective 1 from a remote source in a direction parallel to the arrow Z, would, after reflection by the objective 1 and field element 2, strike the center of the main feed 3 at a normal to its surface.

The foregoing components are maintained in the described postional relationship to each other by conventional supporting structure, not shown and forming no part of this invention. Such structure may, in turn, be supported in known manner for rotation as a unit about one or more axes for orienting the principal directive axis Z as desired.

In a typical design of the system of FIG. 1, the dimensions are as follows:

Objective: 100 inches × 100 inches

Field Element: 14 inches × 14 inches

Feed surface: 10 inches × 10 inches

The focal length of the objective is 100 inches. The distance between the vertex of the objective 1 and the intersection of the axis of the objecteve with the surface of the field element 2 is 100 inches. The distance between said point on the field element 2 and the center of the feed surface 3 is 10 inches. Note that the shape and orientation of field element 2 is completely defined by the locations of points F1, F21 and F23.

The foregoing dimensions provide a magnification M from the objective 1 to the feed surface 3 of about 10. Typically the feed surface 3 and associated combining network 6 are designed to scan (or provide a total angular field of view) about 40° × 40°. This results in a field of view of about 4° by 4° at the objective.

In the operation of the described system, the amplitude distribution over the feed surface 3 is tapered from a maximum at the center to a minimum at the edges, resulting in a similar amplitude distribution over the objective surface 1, for reducing side lobes in accordance with conventional practice. The combining network 6 is adjusted to provide a phase distribution over the feed surface 3 that will produce a main beam from the objective 1 oriented at a desired angle with respect to the boresight axis Z, and at the same time compensate aberrations such as coma and vignetting.

The phase and amplitude adjustments for each feed element 4 may be determined analytically or experimentally or by analytical approximation and experimental confirmation and minor correction.

Assuming a plane wave of constant amplitude arriving at the objective 1 from a distant source in a specified direction, the relative phase and amplitude at each point on the surface of objective 1 can be determined. The relative phase and amplitude at each point on field element 2 is the summation of components reaching it from every point on the objective 1. Similarly, the relative phase and amplitude at any point on the feed plane 3 is the summation of components reaching it from every point on the field element 2.

Thus, in theory, the phase and amplitude adjustments in the combining network 6 for each radiator element 4 to provide additive combination at the network port could be determined, taking into account the tapered amplitude distribution for controlling side-lobes. The same adjustments would cause radiation of a beam in the specified direction when the utilization device 7 is a transmitter.

In practice, it is infeasible to calculate the relative phase and amplitude at each of the infinite number of methematical points on each surface. Instead, the relative phase and amplitude are calculated at each of a number of selected points disposed over each surface, and assumed to be the same throughout a small elemental area surrounding each respective point.

Figure 2:
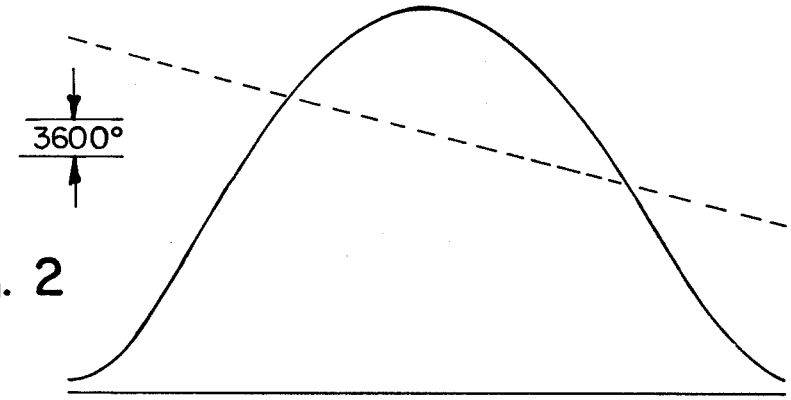
FIG. 2 is a graph showing amplitude and phase distributions on one linear portion of the objective for a particular off-axis orientation of the main beam of the system.

Referring to FIG. 2, the solid line graph shows the amplitude distribution along one linear portion of the objective 1 for a particular off-axis orientation of the main beam. The dash line graph shows the relative phase along said portion. The legend indicates the scale of relative phase angle in degrees. Note that the amplitude varies smoothly from a maximum near the center to a minimum at each end of the linear portion, and the phase changes uniformly along said portion, signifying a well collimated main beam.

Figure 3:
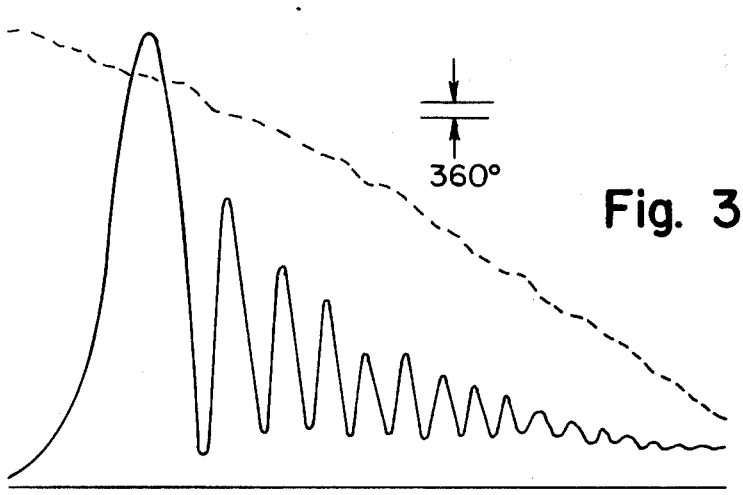
FIG. 3 is a graph showing amplitude and phase distribution on a corresponding linear portion of the field element for said orientation.

FIG. 3 shows the corresponding phase and amplitude distribution along a corresponding linear portion of the field element 2. Note that this corresponding portion extends over a relatively small part of the field element. The relative amplitude, represented by the solid line, is seen to vary markedly in a damped oscillatory manner as a function of position across the field element 2. The relative phase, represented by the dash line, varies in this example from a maximum at one side to a minimum at the other. These variations indicated the nature of the corrections that are made to compensate abberrations in the system.

Figure 4:
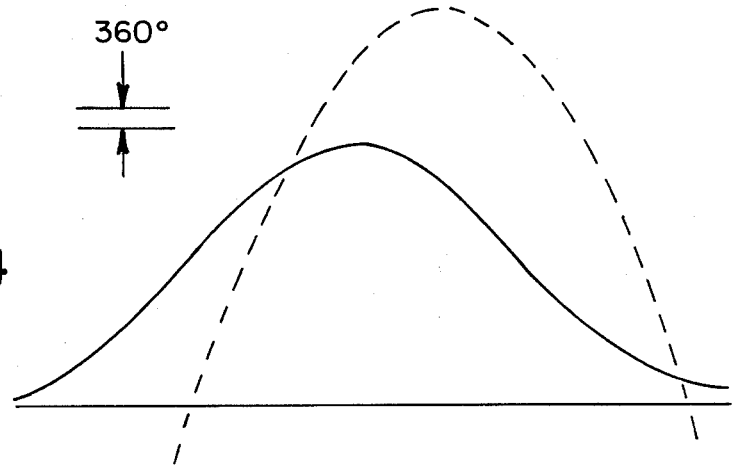
FIG. 4 is a graph showing amplitude and phase distributions on a corresponding linear portion of the primary array or sensor surface for said orientation.

Referring to FIG. 4, the solid line and dotted line show respectively the corresponding relative amplitude and phase distributions along a corresponding linear portion of the feed surface 1. Both vary relatively smoothly from a minimum through a maximum and then to a minimum, with the amplitude curve approximately centered and the phase curve offset in the same sense as the offset pointing of the main beam.

In many cases satisfactory scanning or pointing of the main beam can be achieved by phase control only in the combining network 6, without changing the amplitude adjustments, permitting substantial simplification of the combining network 6 and controller 8. For reasons not presently understood, the described system retains a constant angular field of view or scanning capability independently of the frequency of operation. This is in contrast to directive antennas generally, which exhibit a decreasing field of view with increasing frequency.

What I claim is:

1. A directive antenna system comprising:

(a) a directive feed having an angular field M times that of the system, (b) an objective element consisting of a concave sheet of reflective material in the form of a section of a paraboloid of revolution, said objective element having a principal focus at a point F1 and an aperture substantially M times that of said directive feed, and (c) a field element consisting of a concave sheet of reflective material in the form of a section of an ellipsoid of revolution disposed with its center substantially at said point F1 and having two foci, one substantially at the center of the surface of said objective element and the other substantially at the center of said directive feed, said field element having an aperture sufficient to cover the angular field of said directive feed.

2. The system of claim 1, wherein said directive feed is a scanning device.

3. The system of claim 1, wherein said directive feed is a phased array.

* * * * *